US005842350A

United States Patent [19]

Spinner et al.

[11] Patent Number: 5,842,350

[45] Date of Patent: Dec. 1, 1998

[54] REFRIGERATING METHOD AND DEVICE

[75] Inventors: Bernard Spinner, Corneilla del Vercol; Philippe Boye, Sete; Didier Heinry, Perpignan, all of France

[73] Assignee: Manufactures De Vetements Paul Boye S.A., Sete, France

[21] Appl. No.: 849,379

[22] PCT Filed: Oct. 6, 1995

[86] PCT No.: PCT/FR95/01307

§ 371 Date: Jun. 3, 1997

§ 102(e) Date: Jun. 3, 1997

[87] PCT Pub. No.: WO97/14004

PCT Pub. Date: Apr. 17, 1997

[51] Int. Cl.[6] ..... F25B 17/08; F25B 35/04

[52] U.S. Cl. ..... 62/86; 62/259.3; 62/480; 62/112

[58] Field of Search ..... 62/101, 476, 480, 62/259.3, 112, 86

[56] References Cited

U.S. PATENT DOCUMENTS

| | | | |
|---|---|---|---|
| 1,729,083 | 9/1929 | Miller et al. | 62/480 |
| 2,253,907 | 8/1941 | Levine | 62/5 |
| 4,126,016 | 11/1978 | Greiner | 62/457.7 |
| 4,993,239 | 2/1991 | Steidl et al. | 62/480 |
| 5,111,668 | 5/1992 | Parrish et al. | 62/259.3 |
| 5,165,247 | 11/1992 | Rockenfeller et al. | 62/77 |
| 5,167,498 | 12/1992 | Rockenfeller | 423/299 |
| 5,207,073 | 5/1993 | Maier-Laxhuber | 62/269 |
| 5,384,101 | 1/1995 | Rockenfeller | 422/211 |
| 5,522,228 | 6/1996 | Guillot et al. | 62/101 |
| 5,692,381 | 12/1997 | Garrett | 62/60 |

FOREIGN PATENT DOCUMENTS

| | | |
|---|---|---|
| 744759 | 2/1933 | France . |
| 982202 | 7/1951 | France . |
| 2172754 | 5/1973 | France . |
| 2393246 | 12/1978 | France . |
| 2 489488 | 3/1982 | France . |
| 2 719367 | 3/1995 | France . |
| 442923 | 4/1927 | Germany . |

*Primary Examiner*—William Doerrler
*Attorney, Agent, or Firm*—Stevens, Davis, Miller & Mosher, L.L.P.

[57] ABSTRACT

The invention relates especially to a refrigerating device comprising a pressure-resistant container (1) furnished with an adsorbent material (2), which device furthermore comprises an adjustably set valve (7) whose passage communicates, on the one hand, with the inside of the container and, on the other hand, with the outside, and means (5, 6) for bringing said container temporarily into communication with a pressurized source (10, 11) of gas which can be adsorbed by said adsorbent material.

Use in refrigerated clothing or portable refrigerators.

16 Claims, 1 Drawing Sheet

REFRIGERATING METHOD AND DEVICE

FIELD OF THE INVENTION

Figure 1:
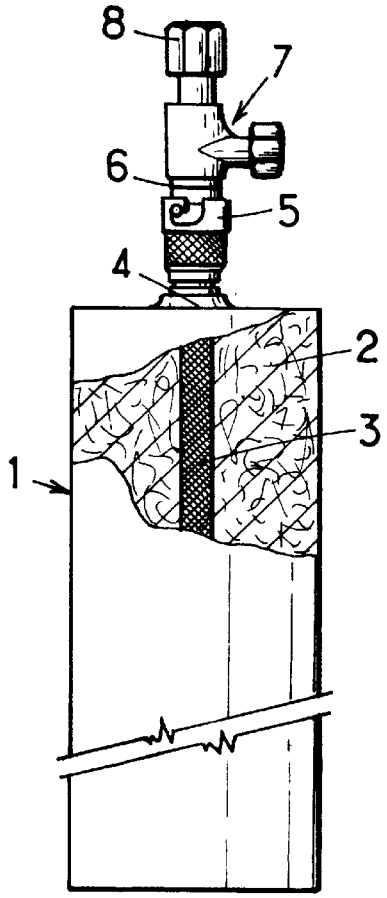

The invention relates to a refrigerating method and a refrigerating device.

BACKGROUND OF THE INVENTION

There is a need for a refrigerating device which is lightweight, portable and nonelectric in various fields, such as portable refrigerators, refrigerated clothing, etc.

It has already been proposed to produce cold by the adsorption of $CO_2$ on an adsorbent material and then desorption of the adsorbed gas. EP-A-0,523,849 describes a device, based on this principle, consisting of a cylinder which contains an adsorbent material and a compressible gas (such as $CO_2$) and of a piston actuated by a compressor in order to compress the gas so as to make it be adsorbed by the adsorbent material. When the piston is retracted, the gas is desorbed and produces cold. By successive compressions and decompressions, a cold region and a hot region are created in the mass of adsorbent material. Means (fins) are provided in order to cool the hot region and to convey the frigories from the cold region to an enclosure to be refrigerated.

This device, which requires a compressor in order to actuate the piston, suffers from being heavy and bulky. This is manifestly not a refrigerating device designed to be lightweight and portable.

Likewise, the Applicant Company claims, in French Patent Application No. 93/09348 filed on Jul. 29, 1993, a device for producing cold by adsorption/desorption of $CO_2$, comprising at least one enclosure furnished with an adsorbent solid material, wherein this adsorbent material comprises activated-carbon fibers or an activated charcoal and has a specific surface area of at least 700 $m^2/g$ and an external specific surface area of at least 0.005 $m^2/g$. The aforementioned application also specifically describes refrigerating systems of the simple effect type or of the resorption type which require the use of two interconnected enclosures and of heating means and which therefore do not lend themselves to producing lightweight and portable systems.

The need for a method of producing cold, which can be used in lightweight and portable devices, has therefore not hitherto been met.

The invention relates to a novel method of producing cold by adsorption of a pressurized gas, which can be adsorbed by an adsorbent material held in a container, and then desorption of said gas, wherein the gas is desorbed under a controlled pressure greater than atmospheric pressure and wherein the desorbed gas is discharged to atmosphere or captured in a trap.

Contrary to the prior methods, the desorbed gas is neither reused nor transferred to another enclosure in order to be subsequently recycled, and this feature allows refrigerating devices to be produced which are simple, lightweight and portable.

By "controlled pressure" is meant a constant or substantially constant pressure or a variable pressure whose variation is regulated depending on a given parameter, especially the temperature of the device used to implement said method or of the article or enclosure cooled by the cold generated by means of a device implementing the present method.

The desorption of the gas is carried out under a controlled pressure greater than atmospheric pressure so as to prevent air from being able to get back into the container holding the adsorbent material.

The present invention also relates to a refrigerating device which is lightweight, portable and simple to produce.

More particularly, the invention relates to a refrigerating device comprising a pressure-resistant container furnished with an adsorbent material, which device furthermore comprises an adjustably set valve whose passage communicates, on the one hand, with the inside of the container and, on the other hand, with the outside, and means for bringing said container temporarily into communication with a pressurized source of gas which can be adsorbed by said adsorbent material.

According to one particular embodiment, said means consist of a two-part quick-action coupling of the self-sealing type, one of the parts of which is fixed to the container and the other part of which is fixed to the valve, so that the container can be disconnected from the valve and connected to said pressurized source in order to be filled with adsorbable gas.

As a variant, a percussion-type recharging system could also be used, that is to say one of the type comprising a needle whose channel is connected via a valve or the like to the chamber delimited by the container and a membrane which is provided on a pressurized absorbable gas source and which is transpierced by the needle when it is desired to "recharge" the container.

Preferably, the adsorbable gas is carbon dioxide ($CO_2$) and the outlet of the valve emerges directly into the atmosphere.

As a variant, the adsorbable gas could be ammonia ($NH_3$), in which case the outlet of the valve would emerge into a water trap intended to absorb the desorbed ammonia and to prevent or greatly minimize its release into the atmosphere.

It is also possible to envisage using a system involving several adsorbed substances so as to base the production of cold on two or more enthalpic systems (co-adsorption) instead of one. An example of such a system is the carbon dioxide/water system.

The container of the device of the invention must be capable of holding the pressure of the adsorbable gas introduced. For example, the container may be made of a metal such as steel or made of a composite material which is a good heat conductor, for example a polymeric material filled with metal fibers.

Advantageously, the container has a substantially cylindrical elongate shape in order to provide a large heat exchange area.

Preferably too, in order to guarantee good access for the adsorbable gas to the entire mass of adsorbent material filling the container, the inlet orifice for the adsorbable gas is provided at one end of the container and an access path is provided for the gas by placing a small tube which is perforated or made of mesh in the container, extending from the inlet orifice for the adsorbable gas right to the opposite end of the container.

The adsorbent material may be of any kind. Examples of preferred absorbent materials are activated-carbon fibers having a specific surface area of at least 700 $m^2/g$, preferably at least 1000 $m^2/g$, and having an external surface area of at least 0.2 $m^2/g$, such as the fibers sold under the name AD'ALL by the Japanese company OSAKA GAS Co. Ltd. or under the names KF (or K-Filter) and AF by the Japanese company TOYOBO Co. Ltd., Osaka, Japan, activated charcoals having a specific surface area of at least 700 $m^2/g$, preferably at least 1000 $m^2/g$, and having an external specific surface area of at least 0.005 $m^2/g$, preferably at least 0.02 $m^2/g$, such as the charcoals sold under the name PICACTIF, reference TA 60 or TA 90, by the company PICA, 92309 Levallois, France.

Advantageously, it is possible to mix a material which is a good heat conductor with the adsorbent material so as to improve the heat exchange within said adsorbent material and between the latter and the wall of the container. A preferred example of such a material which is a good heat conductor is recompressed expanded graphite. Expanded graphite is available from the company LE CARBONE-LORRAINE.

The mixture of recompressed expanded graphite and the adsorbent material may be made by firstly compressing expanded graphite, for example in a cylinder by means of a piston, and then by impregnating the porous block of recompressed expanded graphite obtained with a suspension of fine particles of adsorbent material in a liquid medium (water or another liquid) which is removed after impregnation, for example by controlled heating.

Self-sealing quick-action couplings are well-known articles marketed, for example, by the company STAUBLI, 74210 Faverges, France, as are adjustably set valves, for example those set by means of an adjustable compression spring, which may be obtained, for example, from the NUPRO COMPANY, Willoughby, Ohio (U.S.A.).

The operation of the device of the invention is very simple, it suffices, after disconnecting the valve, to connect the container to an adsorbable gas source, such as a carbon dioxide cylinder fitted with a pressure-relief valve, until the adsorbent material has adsorbed the desired quantity of adsorbable gas, which may be determined simply by weighing. The time necessary to recharge depends on various parameters, but a suitable time may easily be determined once and for all by a simple routine experiment. Recharging usually requires only a few minutes. Likewise, most producers of adsorbent materials supply charts enabling the volume of adsorbed gas to be determined for a given pressure and temperature pair.

The recharging pressure is solely limited by the mechanical strength of the container of the present device and by the available adsorbable gas source. By way of indication, in the case of $CO_2$ as adsorbable gas, the recharging pressure could range from 2 to 72 bar and higher (at an ambient temperature of 30° C.). The higher the gas pressure in the container, the greater the amount of cold which can be produced by a given device.

Having completed the recharging, the device is disconnected from the source and the valve and container are reconnected, the valve being set to an opening pressure greater than the internal pressure existing in the container in order to avoid any inadvertent gas leak.

When it is desired to produce cold using the device, it suffices to set the valve to an opening pressure less than the internal pressure existing in the container so that desorption of the adsorbed gas occurs and generates frigories which cool the wall of the container. The cold produced may be exchanged with air or a fluid in any suitable manner. For example, a stream of air or liquid to be cooled may be made to flow around the container using a fan, pump or similar device. Heat exchange may be increased by providing heat-exchange means known per se, such as metal fins or the like, around the container.

The device of the invention is useful in all fields of application requiring a lightweight and autonomous source of cold. Mention may be made, purely by way of indication, of refrigerated clothing and portable refrigerators.

The description which follows, given with reference to the drawings, will make the invention clearly understood.

Figure 2:
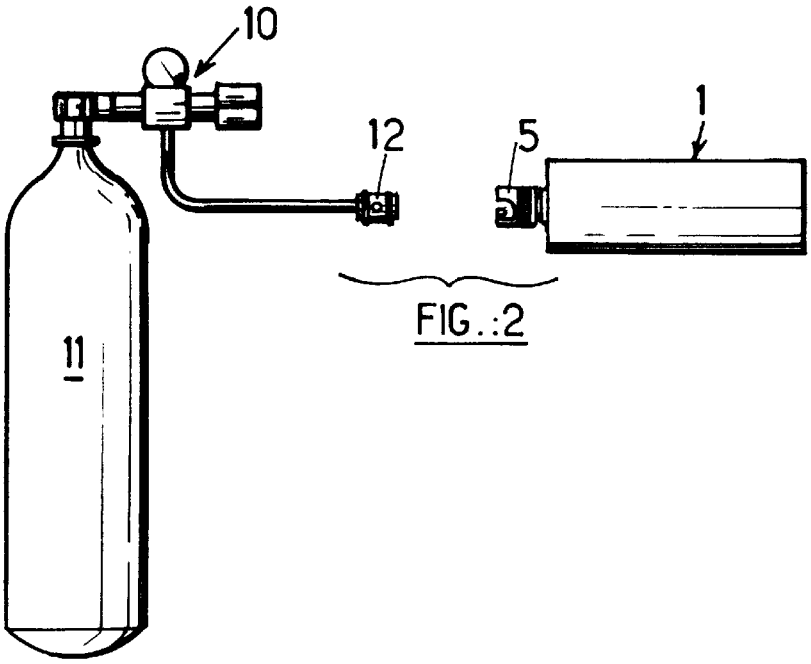

FIG. 1 is a diagrammatic view of a refrigerating device according to the invention; and FIG. 2 is a diagrammatic view illustrating the recharging of the device of FIG. 1.

The refrigerating device of the invention comprises a cylindrical stainless-steel container 1 having a length of 165 mm, an internal diameter of 30.5 mm and an external diameter of 33.7 mm, furnished with a mixture 2 of 34.7 g of PICACTIF TA 90 activated charcoal and 18.7 g of expanded graphite, initially having a density of 0.04, which has been recompressed.

Provided at the center of the mass of adsorbent material is a small cylinder 3 formed by a fine-celled mesh extending from one end of the container to the other and intended to provide easy access for the adsorbable gas to all parts of the adsorbent material. An orifice 4 is provided at one of the ends of the cylinder and the female part 5 of a self-sealing quick-action coupling is welded around this orifice. The male part 6 of the quick-action coupling is itself welded to a valve 7 which can be adjustably set by means of a knob 8. In FIG. 1, the male part and the female part of the coupling are shown in a coupled position.

By way of indication, the coupling used, supplied by the company STAUBLI, comprised a 5.5 SPM coupling (female part) and a 5.5 SPM end fitting (male part). The adjustably set valve (which can be set between 0 and 15 bar), of the 316 L type, came from the American company NUPRO.

FIG. 2 illustrates diagrammatically the recharging of the device of FIG. 1.

After disconnecting the two parts 5 and 6 of the quick-action coupling, the container 1 is connected to the pressure-relief valve 10 of a bottle 11 of pressurized adsorbable gas (for example $CO_2$) by coupling the female part 5, fastened to the container 1, to a male quick-action coupling part 12, similar to the male part 6, connected to the pressure-relief valve 10. All that then requires to be done is to open the pressure-relief valve in order for recharging to take place. Once recharging has been completed, the pressure-relief valve is closed, the parts 5 and 12 are disconnected and, after closing the valve 7, the parts 5 and 6 are reconnected.

Given below, by way of nonlimiting example, are the results of two tests carried out using the device of FIG. 1, the first in constant-pressure operating mode and the second in variable-pressure operating mode.

EXAMPLE 1

Constant-Pressure Mode

The device was charged with $CO_2$ until the internal pressure in the adsorber was 8.8 bar for an external temperature of 13° C.

The setting (opening pressure) of the valve was adjusted to 1.3 bar. The temperatures $T_1$ and $T_2$ were measured at two different points on the wall of the container, one ($T_1$) located near that end of the container where the orifice 4 of the container is and the other ($T_2$) located near the other end of the container 1.

The results are given in the following table. The pressure p in the container was periodically measured using a pressure gage connected directly to the container.

| t(min) | $T_1$ | $T_2$ | p |
|---|---|---|---|
| 0 | 16 | 13 | 8.77 |
| 2 | 2 | 3 | 1.31 |
| 2.5 | 3 | 1 | 1.29 |
| 3 | 1 | 0 | 1.26 |
| 3.5 | 1 | 0 | 1.25 |
| 4 | 1 | 0 | 1.25 |
| 4.5 | 1 | 0 | 1.25 |
| 5 | 2 | 0 | 1.25 |
| 5.5 | 2 | 1 | 1.25 |
| 6 | 2 | 1 | 1.25 |
| 6.5 | 2 | 1 | 1.25 |
| 7 | 3 | 2 | 1.26 |
| 7.5 | 3 | 2 | 1.26 |
| 8 | 3 | 2 | 1.26 |
| 8.5 | 4 | 3 | 1.26 |
| 9.5 | 4 | 3 | 1.29 |
| 10 | 5 | 4 | 1.3 |
| 10.5 | 5 | 4 | 1.31 |
| 11 | 5 | 4 | 1.32 |
| 12 | 6 | 5 | 1.34 |
| 13 | 6 | 5 | 1.35 |
| 14 | 7 | 6 | 1.35 |
| 15 | 7 | 6 | 1.32 |
| 16 | 7 | 6 | 1.35 |
| 17 | 7 | 6 | 1.36* |
| 18 | 8 | 7 | 1.37 |
| 19 | 8 | 7 | 1.38 |
| 20 | 8 | 7 | 1.39 |
| 21 | 8 | 7 | 1.4 |
| 24 | 9 | 12 | 1.43 |
| 25 | 10 | 12 | 1.44 |
| 50 | 12 | 11 | 1.51 |
| 85 | 13 | 11 | 1.58 |

*Closing of the valve

EXAMPLE 2

Variable-Pressure Mode

Initially, the device was charged with $CO_2$ until the internal pressure in the adsorber was 8.2 bar for an ambient temperature of 12° C.

In this test, the setting of the valve was adjusted manually depending on the temperature of the wall so as to maintain the temperature of the wall close to 6°–7° C.

The pressure p and the temperatures $T_1$ and $T_2$ were measured as described in Example 1. The results obtained are given in the table below:

| t(min) | p | $T_1$ | $T_2$ | $T_{amb}$ |
|---|---|---|---|---|
| 0 | 7.86 | 12 | 12 | 12 |
| 2 | 4.55 | 8 | 8 | 12 |
| 2.5 | 4.51 | 7.5 | 8 | 12 |
| 3 | 4.52 | 7.8 | 8 | 12 |
| 3.5 | 4.52 | 8 | 8 | 12 |
| 4 | 4.51 | 8 | 8 | 12 |
| 4.5 | 4.51 | 8 | 8 | 12 |
| 5 | 4.51 | 8 | 8 | 12 |
| 6 | 4.51 | 8 | 8 | 12 |
| 6.5 | 4.35 | 7 | 7 | 12 |
| 9 | 3.18 | 6 | 7 | 12 |
| 9.5 | 3.17 | 6 | 7 | 12 |
| 10 | 3.17 | 6 | 7 | 12 |
| 11 | 3.17 | 6 | 7 | 11 |
| 12 | 3.17 | 6 | 7 | 11 |
| 13 | 2.85 | 6 | 7 | 11 |
| 14 | 2.77 | 6 | 7 | 11 |
| 15 | 2.72 | 6 | 7 | 11 |
| 16 | 2.7 | 6 | 7 | 11 |
| 17 | 2.68 | 6 | 7 | 11 |

-continued

| t(min) | p | $T_1$ | $T_2$ | $T_{amb}$ |
|---|---|---|---|---|
| 18 | 2.68 | 6 | 7 | 11 |
| 19.5 | 2.3 | 6 | 7 | 11 |
| 20 | 2.16 | 5 | 6 | 11 |
| 21 | 2.07 | 5 | 6 | 11 |
| 22 | 2.01 | 5 | 6 | 11 |
| 24 | 1.97 | 5 | 6 | 11 |
| 25 | 1.96 | 5 | 6 | 11 |
| 26 | 1.94 | 5 | 6 | 11 |
| 27 | 1.55 | 5 | 6 | 11 |
| 28 | 1.46 | 4 | 5 | 11 |
| 29 | 1.4 | 4 | 5 | 11 |
| 30 | 1.37 | 4 | 5 | 11 |
| 32 | 1.31 | 4 | 5 | 11 |
| 35 | 1.26 | 4 | 6 | 11 |
| 36 | 1.29 | 5 | 6 | 11 |

By comparing the results obtained in Examples 1 and 2, it may be seen that the constant-pressure mode enables relatively strong cooling to be obtained for a relatively short time, while the variable-pressure mode enables more modest cooling to be obtained but for a longer period.

It goes without saying that the embodiment described is merely an example and that it could be modified, especially by substitution of technical equivalents without thereby departing from the scope of the invention.

We claim:

1. A method for producing cold, comprising:

adsorbing pressurized carbon dioxide in an adsorbent material held in a container, and then desorbing said carbon dioxide under a controlled pressure greater than atmospheric pressure, the desorbed carbon dioxide being discharged to atmosphere and said adsorbent material being selected from at least one member of the group consisting of activated carbon fibers and activated charcoals.

2. The method as claimed in claim 1, wherein carbon dioxide is desorbed at a substantially constant pressure.

3. The method as claimed in claim 1, wherein carbon dioxide is desorbed at a variable pressure, the variation of which is regulated as a function of a given temperature.

4. The method as claimed in claim 1, wherein said adsorbent material is mixed with a material which is a good heat conductor.

5. The method as claimed in claim 4, wherein said heat-conductor material is recompressed expanded graphite.

6. The method as claimed in claim 1, wherein the carbon dioxide pressure is at least 2 bars.

7. The method as claimed in claim 1, wherein the method steps are caused to be performed without electrical power.

8. The method as claimed in claim 1, wherein said adsorbent material in said container consists essentially of said adsorbent material selected from at least one member of the group consisting of activated carbon fibers and activated charcoals.

9. A refrigerating device comprising a pressure-resistant container furnished with an adsorbent material selected from at least one member of the group consisting of activated carbon fibers and activated charcoals, which device further comprises an adjustably set valve whose passage communicates, on the one hand, with the inside of the container and, on the other hand, with the outside, said device further comprising means for bringing said container temporarily into communication with a pressurized source of carbon dioxide.

10. The device as claimed in claim 9, wherein said means for bringing consists of a two-part quick-action coupling of the self-sealing type, one of the parts of which is fixed to the container and the other part is fixed to the valve, so that the container can be disconnected from the valve and connected to said pressurized source in order to be filled with carbon dioxide.

11. The device as claimed in claim 9, which further comprises a small tube which is perforated or made of mesh, extending from an inlet orifice for carbon dioxide, provided at one end of the container, to the opposite end of the container.

12. The device as claimed in claim 9, wherein said adsorbent material is mixed with a material which is a good heat conductor.

13. The device as claimed in claim 12, wherein said heat-conductor material is recompressed expanded graphite.

14. The device as claimed in claim 9, wherein the pressurized source of carbon dioxide is a pressurized source of carbon dioxide having a pressure of at least 2 bar.

15. The device as claimed in claim 9, having an absence of an electrical power supply.

16. The device as claimed in claim 9, wherein adsorbent material of said device consists essentially of said adsorbent member selected from at least one member of the group consisting of activated carbon fibers and activated charcoals.

* * * * *